US006651573B2

(12) United States Patent
Aselton et al.

(10) Patent No.: US 6,651,573 B2
(45) Date of Patent: Nov. 25, 2003

(54) PERSONAL WATERCRAFT

(75) Inventors: Ron Aselton, Sterling Heights, MI (US); Rick Adamczyk, St. Cloud, FL (US); David Kalhok, Marion, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/864,876

(22) Filed: May 25, 2001

(65) Prior Publication Data

US 2001/0047744 A1 Dec. 6, 2001

Related U.S. Application Data

(60) Provisional application No. 60/207,238, filed on May 26, 2000.

(51) Int. Cl.[7] ..... B63B 35/73

(52) U.S. Cl. ..... 114/55.57; 114/55.5; 114/363

(58) Field of Search ..... 114/55.5, 55.51, 114/55.53, 55.55, 55.57, 343, 360, 363

(56) References Cited

U.S. PATENT DOCUMENTS

| | | | | | |
|---|---|---|---|---|---|
| 5,320,059 | A | * | 6/1994 | Ikeda | 114/363 |
| RE34,922 | E | * | 5/1995 | Hattori et al. | 114/55.55 |
| 5,490,474 | A | * | 2/1996 | Ikeda | 114/343 |
| 5,542,862 | A | * | 8/1996 | Kobayashi | 114/38 |
| 5,584,733 | A | * | 12/1996 | Kobayashi | 114/38 |
| 5,607,332 | A | * | 3/1997 | Kobayashi et al. | 114/41 |
| 5,634,422 | A | | 6/1997 | Kobayashi et al. | |
| 5,669,326 | A | * | 9/1997 | Ikeda | 114/363 |
| 5,676,086 | A | * | 10/1997 | Watkins | 114/55.53 |
| 5,915,329 | A | * | 6/1999 | Watkins et al. | 114/363 |
| 6,145,458 | A | * | 11/2000 | Hattori | 114/55.57 |
| 6,192,823 | B1 | * | 2/2001 | Tsumiyama et al. | 114/363 |
| 6,276,290 | B1 | * | 8/2001 | Yamada et al. | 114/55.51 |

FOREIGN PATENT DOCUMENTS

| | | | | |
|---|---|---|---|---|
| JP | 05-008794 | * | 1/1993 | 114/55.55 |
| JP | 10-035584 | * | 2/1998 | 114/55.53 |

OTHER PUBLICATIONS

Bombardier Parts Catalog, Sea–Doo Explorer, Model 5820, 1994, p. A2, D3, D6 and D8 (Mar. 1994).

Bombardier Parts Catalog 1997, Sea–Doo Jet Boats, Challenger 1800, 5600/5601, 1997, p. A2, D12, E1 and E8 (Mar. 1997).

* cited by examiner

*Primary Examiner*—S. Joseph Morano
*Assistant Examiner*—Ajay Vasudeva
(74) *Attorney, Agent, or Firm*—Pillsbury Winthrop LLP

(57) ABSTRACT

The benefits of a sporty and maneuverable personal watercraft and those of a larger sport boat, having the ability to accommodate a large number of riders, are combined into a single watercraft. The watercraft is equipped with a rear sundeck large enough for passengers to sun bathe while the watercraft is stationary. Disposed beneath the sundeck are storage compartments, each having a lip-less seal for preventing the ingress of water into the compartments. Additionally, the storage compartments are large enough to store a variety of items and accessories such as food, clothes, and first-aid materials. The watercraft is designed such that a relationship between the position of its center of gravity and the position of its center of buoyancy, prevents the watercraft from tipping over even when three of four adults of average size simultaneously board the watercraft from the same side.

23 Claims, 7 Drawing Sheets

PERSONAL WATERCRAFT

This application claims priority to U.S. Provisional Patent Application Serial No. 60/207,238, which was filed on May 26, 2000. That Provisional Application is incorporated herein by reference.

BACKGROUND OF THE INVENTION

1. Field of the Invention

This invention relates to watercraft and more particularly to features for personal watercraft.

2. Description of the Related Art

Various types of watercraft exist, each being suited for different types of activities. The term personal watercraft generally refers to a sporty, jet-propelled watercraft capable of accommodating a driver and, in some instances, two or three passengers. One advantage of a personal watercraft is its maneuverability. A typical watercraft, for example, is capable of making relatively tight turns on the water, and is capable of achieving relatively high speeds.

A characteristic that makes a personal watercraft capable of achieving this kind of maneuverability and speed is its small size and shape which permit it to be ridden like a motorcycle.

A typical personal watercraft provides a small hull defining an engine compartment below a seating area. Because they are usually small and compact, personal watercraft generally are limited in storage space and in the number of passengers they can accommodate.

Larger sport boats, on the other hand, can provide significant storage space and accommodate greater numbers of passengers. However, larger sport boats do so at the expense of sportiness and maneuverability.

Therefore, personal watercraft and larger sport boats satisfy different goals. Personal watercraft are designed for speed, nimbleness, and maneuverability. Large sport boats do not focus on these attributes. Instead, they excel at storage and passenger space. These two attributes have not, heretofore, been combined into a single boat, especially of the type described herein.

SUMMARY OF THE INVENTION

Thus, it is an object of the present invention to provide a watercraft, which combines the speed, maneuverability, and personal convenience of a personal watercraft with the roominess, storage capability, and size of a larger sport boat.

A watercraft, according to the present invention, includes a powered hull and at least one compartment integrally formed within the hull, the compartment being adapted for storage and having an opening thereinto defined by a planar surface.

The watercraft includes a powered hull, a deck attached to the hull defining a central area on which a straddle-type seat is disposed and at least one storage compartment disposed at a stern of the watercraft and being accessible through an opening in the deck. The watercraft also includes at least one deck section mounted to the deck and being moveable between a closed position where the compartment is covered and an open position where the compartment is accessible, wherein, when in the closed position, a top surface of the at least one deck section defines a sun deck area.

Finally, according to the present invention, the planar seal resiliently engages the planar surface when the compartment is closed to prevent the ingress of water into the compartment.

BRIEF DESCRIPTION OF THE DRAWINGS

The accompanying drawings, which are incorporated in and constitute a part of the specification, illustrate embodiments of the invention and, together with the general description given above and the detailed description of the embodiments given below, serve to explain the principles of the invention.

DETAILED DESCRIPTION OF THE PREFERRED EMBODIMENTS

Incorporated herein by reference is the Sea-Doo® Watercraft parts catalog 2000 for the 5688 LRV Watercraft.

Figure 1:
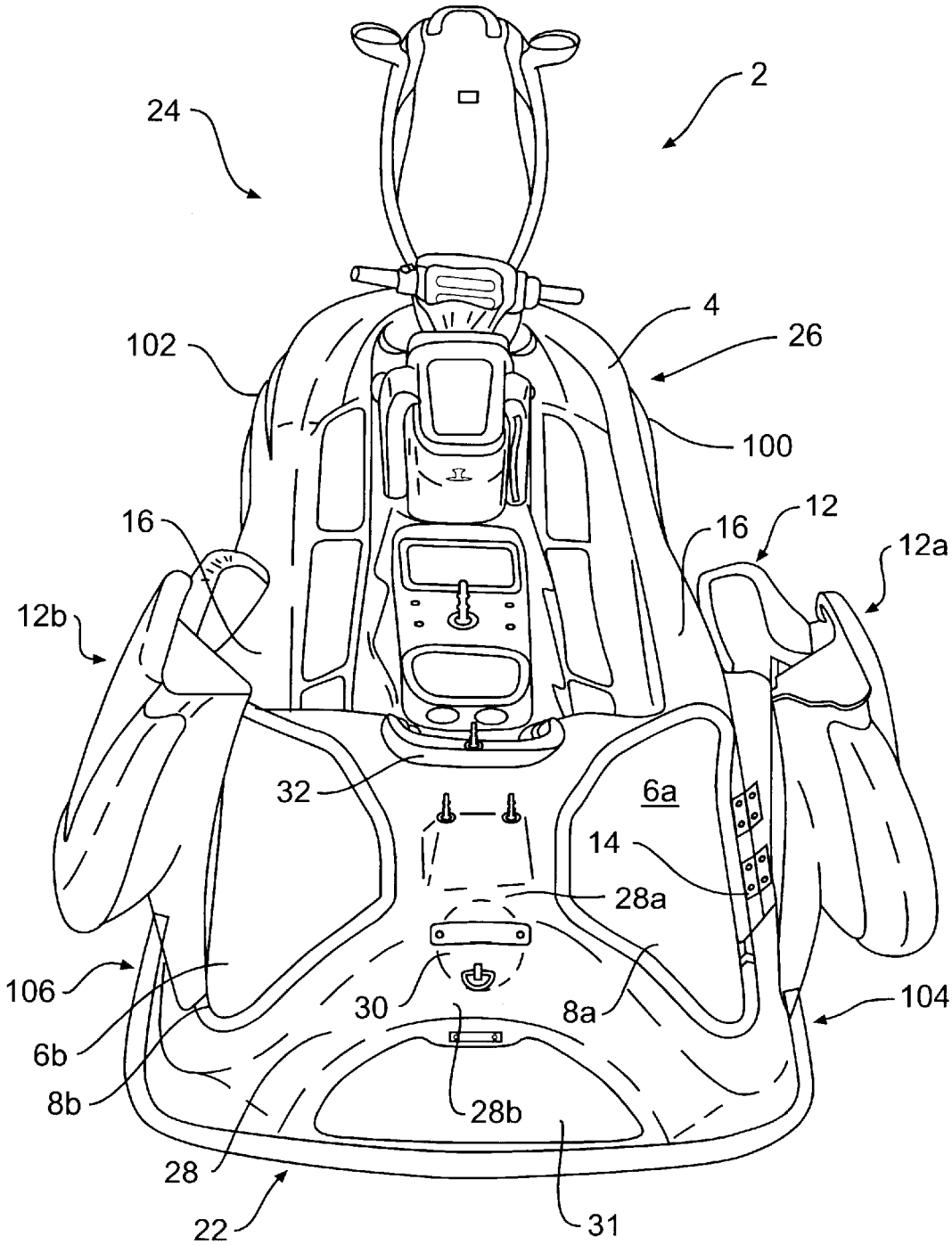
FIG. 1 is a top view of the watercraft of the present invention from a rear perspective.

FIG. 1 is a top view of the improved personal watercraft (2) of the present invention. The watercraft (2) includes at least a stern (22), a port side (24), and a starboard side (26). The basic structure for the watercraft (2) is divided into the hull (4), or lower portion, and the deck (3), or upper portion, that are connected to one another. The hull (4) and deck (3) define a housing for an engine and propulsion system (not shown). Integrally formed within the watercraft (2) are storage compartments **(6*a*) and (6*b*), which are positioned respectively on the starboard side (26) and port side (24) of watercraft (2). In addition, the deck (3) forms a substantially vertical rear wall surface (28) at the stern (22), which includes a top portion (28*a*) and a bottom portion (28*b*)**.

Figure 2:
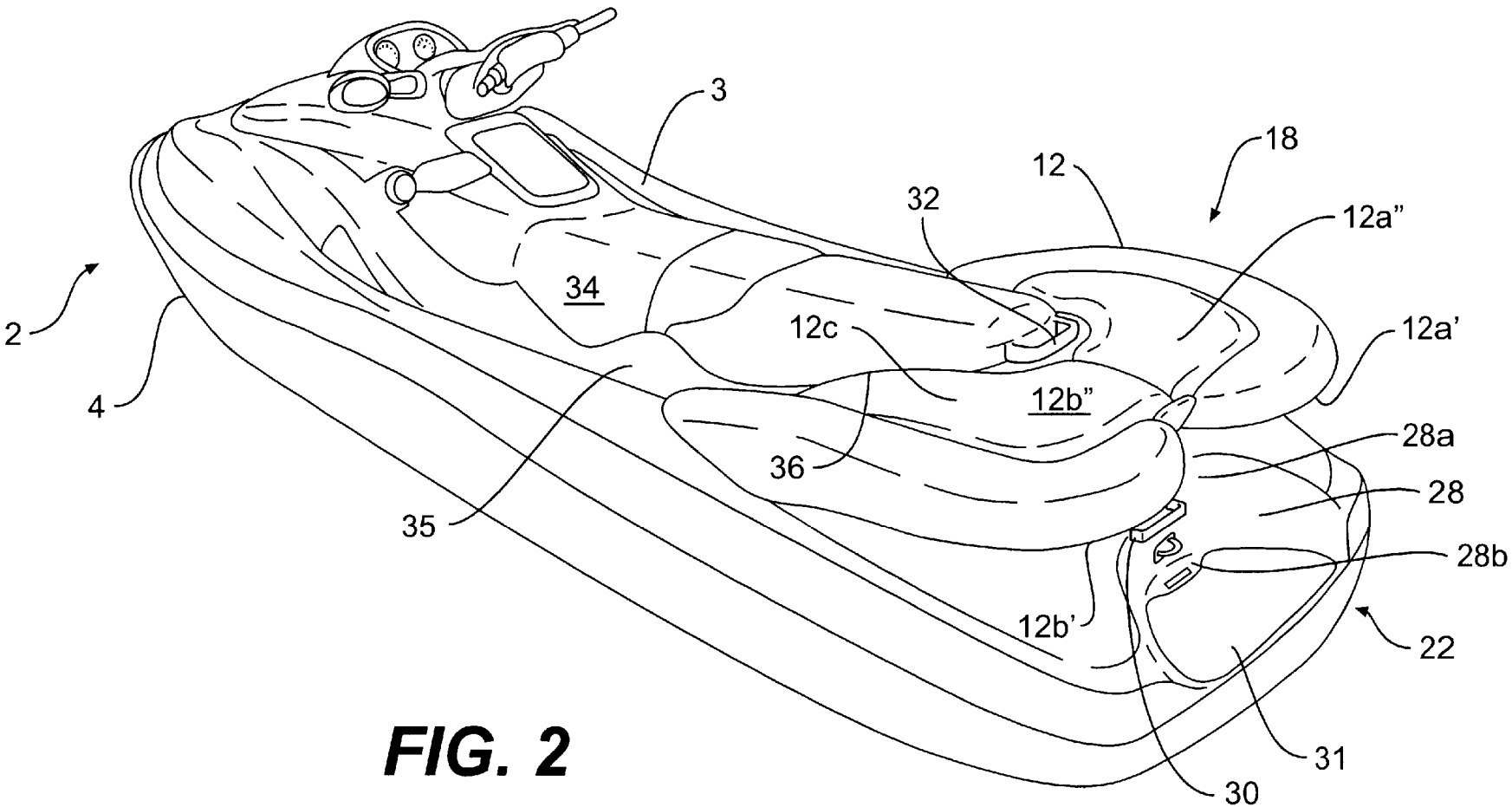
FIG. 2 is a side perspective view of the of the watercraft of the present invention, illustrating grab handles provided at the rear thereof.

FIG. 2 illustrates an entirely new feature for this class of watercraft, a sun deck (12). In an exemplary embodiment, the sun deck (12) is a padded area for lounging and relaxing. The sun deck (12) provides riders with alternative seating and an area on which to sun bathe, or remain seated, but not necessarily in a straddle-type position at the rear of the watercraft (2) while the engine is stopped and the watercraft is not moving. In addition, sun deck (12) provides a platform from which a rider may participate in a wide variety of aquatic activities. The sun deck (12) may have a number of different sections such as section **(12*a*), positioned on the starboard side of the watercraft (2), and section (12*b*) positioned on the port side of the watercraft (2). Each section (12*a*) and (12*b*) is mounted onto the hull (4) by hinges (14). The hinges (14) permit the sections (12*a*) and (12*b*) to be selectively moved between a first open position (16), shown in FIG. 1, and a second closed position (18)**, shown in FIG.

2. Alternatively, the sun deck (12) could be mounted on the deck (3) without storage compartments (6*a*) and (6*b*). Also, the sun deck (12) could be positioned any where on the watercraft (2).

Each section (12*a*) and (12*b*) also acts as a cover for respective storage compartments (6*a*) and (6*b*), which may be used to store a variety of items and accessories such as food, clothes, first aid materials, skis, wake boards, emergency paddles, and/or a tent for weekend activities, for example. The storage compartments (6*a*) and (6*b*) respectively include openings (8*a*) and (8*b*), which provide access to the compartments (6*a*) and (6*b*). In prior art sport boats, the area around any access opening into the hull is provided with a lip to prevent the ingress of water. However, such an arrangement is not necessary on the improved personal watercraft (2) of the present invention, as discussed in detail below.

A lower grab handle (30), which is attached to the rear wall surface (28) of the watercraft (2) is provided. Additionally, an upper grab handle (32), attached to the deck (3), is positioned above the lower grab handle (30). By holding on to the lower and upper grab handles (30) and (32), and using rear deck (31) as a boarding platform, a person may board the watercraft (2) from the water at the stern (22) position. The lower and upper grab handles (30) and (32) provide a graduated access onto the watercraft (2).

Figure 4:
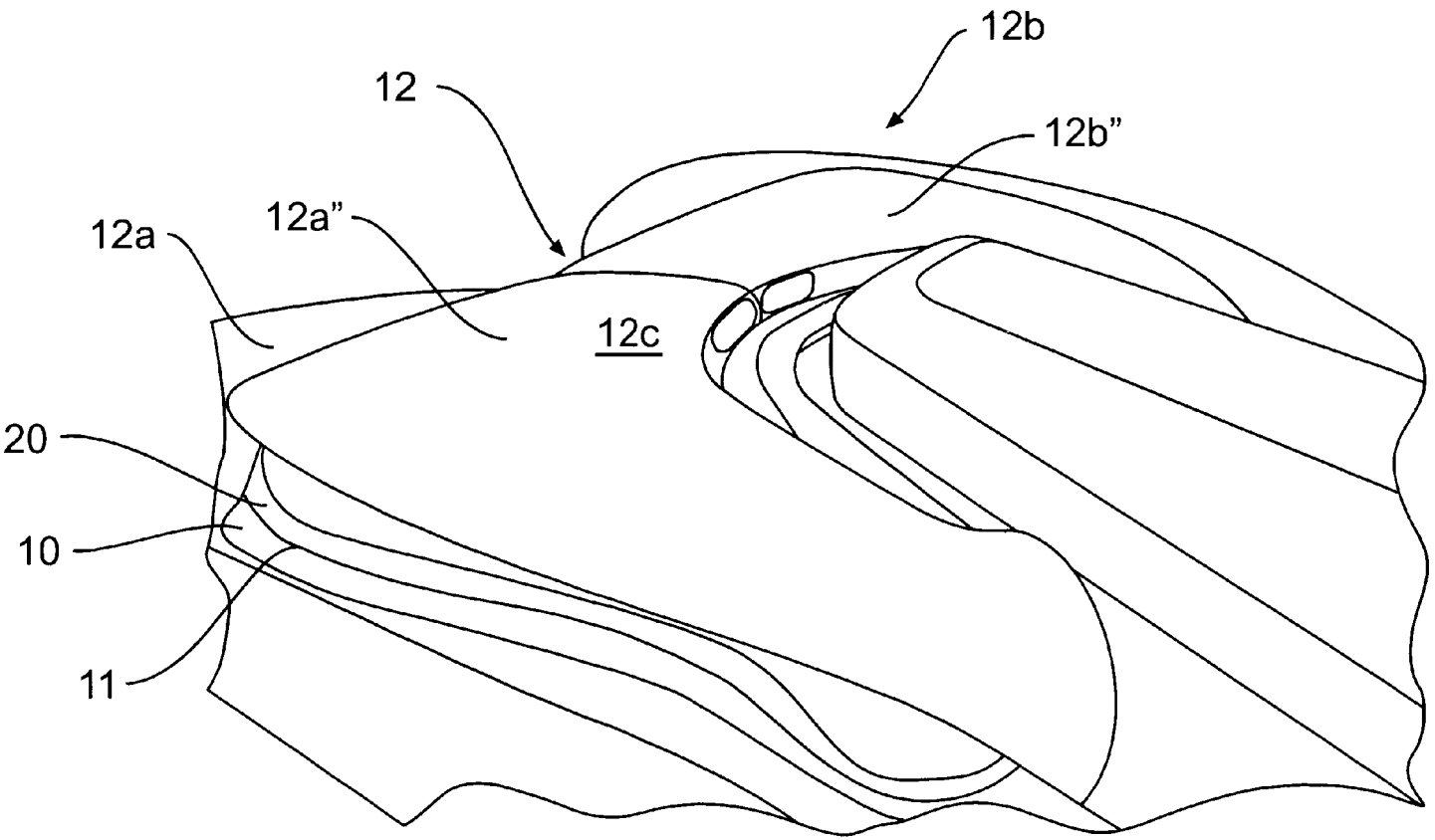
FIG. 4 is a partial side view of the layout of the sundeck of the watercraft of the present invention, illustrating the location of the resilient seal thereunder.

FIG. 2 further illustrates that when the sun deck (12) is in the closed position (18), the lower grab handle (30) is positioned below rear sections (12*a*') and (12*b*') of the sun deck (12). The upper grab handle (32) is positioned between a seat (34) and the sun deck (12). The seat (34), which is disposed longitudinally along a central area (35) of the deck (3) and which provides a straddle-type configuration, provides seating for a driver of the watercraft (2) and three or more passengers. The sun deck (12) is disposed rearwardly (36) of the seat (34) in order to optimize passenger space on the watercraft (2). Additionally, when the sun deck sections (12*a*) and (12*b*) are in the closed position (18), respective top portions (12*a*") and (12*b*") form a substantially flat surface (12*c*), also shown in FIG. 4. The flat surface (12*c*) permits the driver and passenger to comfortably sit or sun bathe while the watercraft (2) is stationary.

Figure 3:
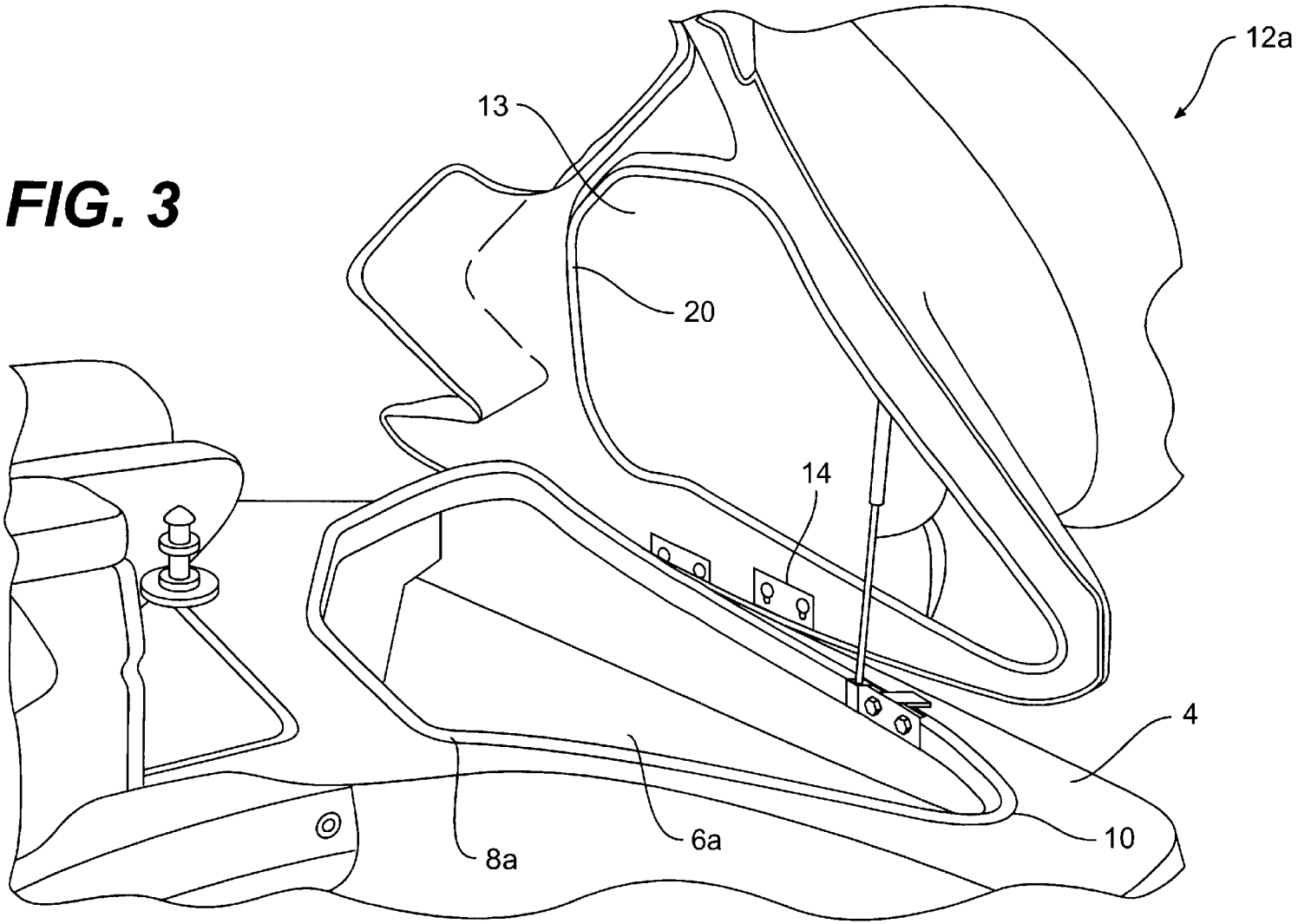
FIG. 3 is a partial rear perspective view of the watercraft of the present invention, showing one storage compartment therein.

As illustrated more clearly in FIG. 3, each compartment opening, for example opening (8*a*) of compartment (6*a*), has a planar surface (10) therearound. The planar surface (10) provides a tight seal with for the corresponding sun deck section (12*a*), which acts as a storage cover for the storage compartment (6*a*). As shown, sun deck section (12*a*) includes a bottom portion (13) which includes a seal (20), formed and shaped to match the shape of the planar surface (10). When the sun deck section (12*a*) is switched from the open position (16) to the closed position (18), the seal (20) resiliently engages the planar surface (10), thus forming a tight seal (11), illustrated in FIG. 4. This tight seal (11) prevents the ingress of water into the storage compartment (6*a*). In the prior art, the ingress of water is prevented by providing the storage compartment opening with a lip, with which the compartment cover may mate. The planar seal approach of the present application, however, can operate with or without a lip, thus providing for a less complicated construction.

Figure 5:
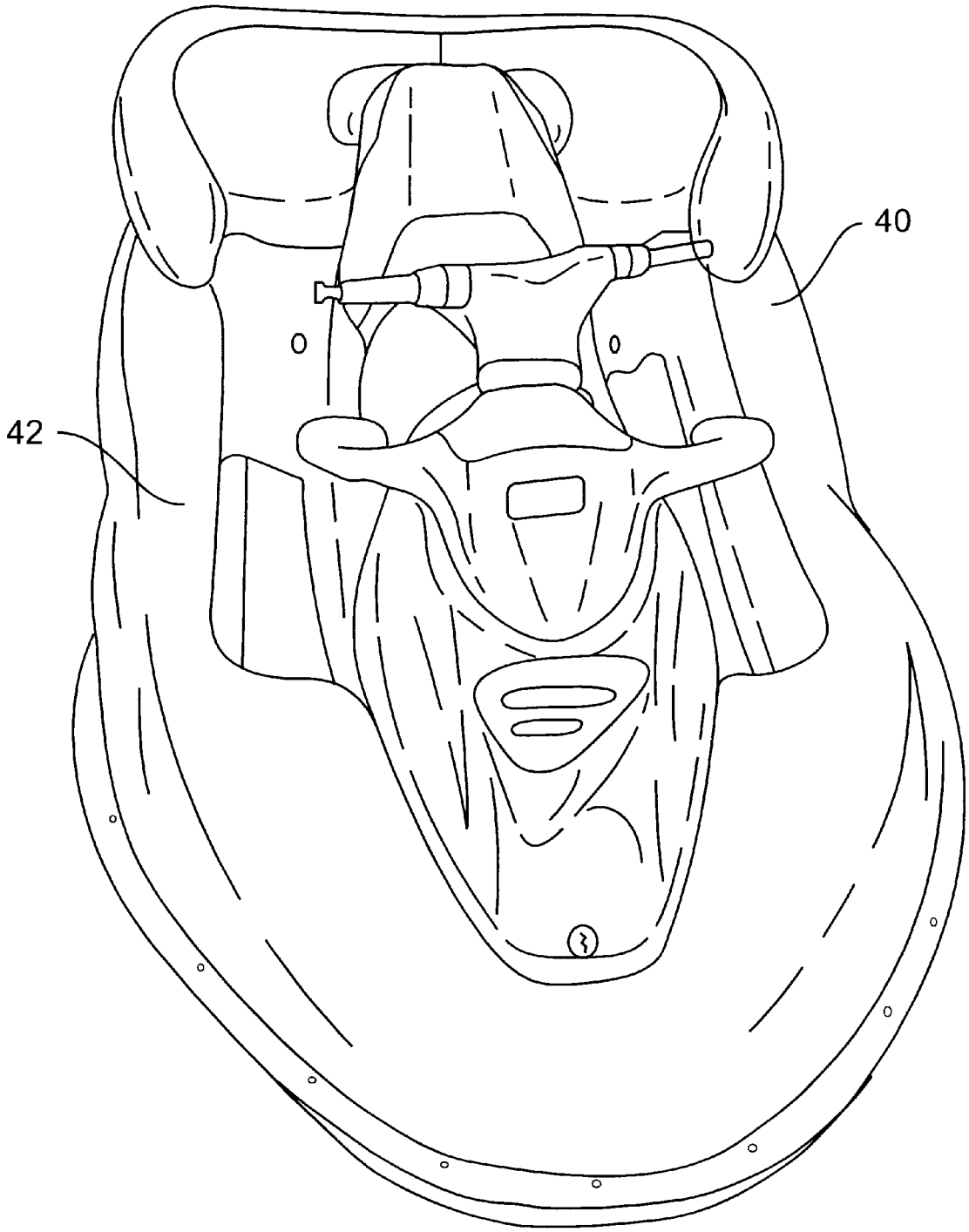
FIG. 5 is a perspective top view of a the watercraft of the present invention.

FIG. 5 illustrates respective port side (24) and starboard side (26) gunwales, (40) and (42), which permit a person to board the watercraft (2) from each of the respective sides.

Watercraft in the prior art have been prone to tip over when a relatively large amount of weight is placed on only one of the gunwales. Such a situation could occur, for example, when more than one person tries to board the watercraft (2) from the same side at the same time. In the exemplary embodiment of the present invention, however, the lateral static stability of the watercraft has been greatly improved.

Figure 6:
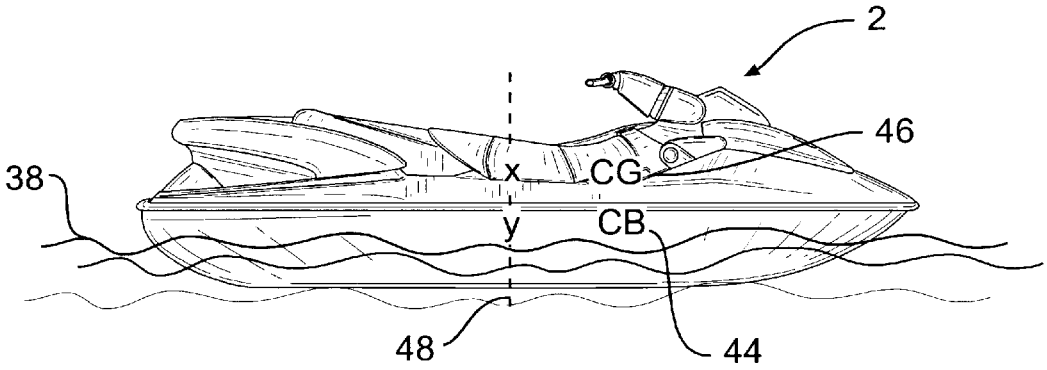
FIG. 6 is a schematic side view of the watercraft of the present invention, illustrating the relationship between the position of the center of gravity and the position of the center of buoyancy.

As shown in FIG. 6, and as generally understood by one skilled in the art of watercraft buoyancy, in order for any body or system, immersed in water, to float so that it is level with the water, its center of gravity must be aligned with its center of buoyancy. The center of gravity is the point in a body or system, around which its mass or weight is evenly distributed and through which a line of force, exerted by the earth's gravitational force, will pass. When an immersed body floats, it displaces a corresponding volume of water. The center of gravity of this displaced volume of water is defined as the center of buoyancy of the immersed body. In order for the immersed body to float on a level plane, its center of buoyancy must be aligned with its center of gravity.

Figure 7:
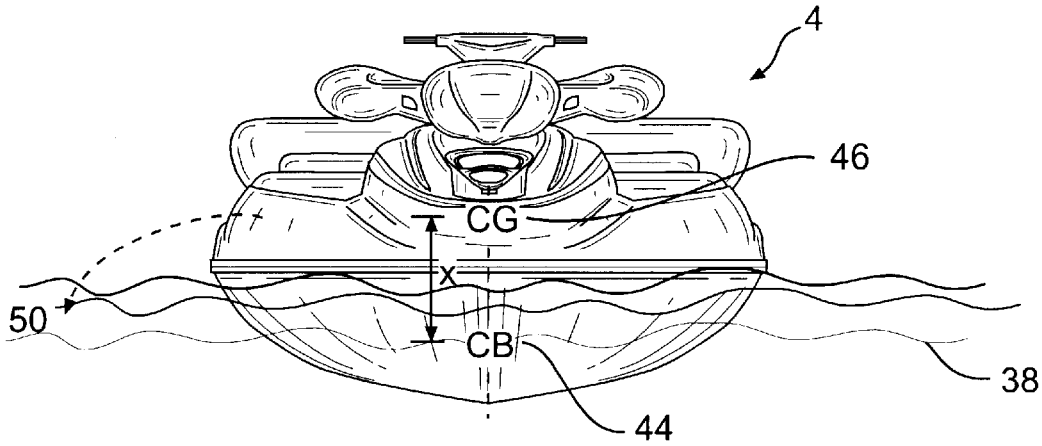
FIG. 7 is a schematic front view of the watercraft of the present invention, showing the relationship between the position of the center of gravity and the position of the center of buoyancy.

Thus, as illustrated in FIG. 6, in order for the watercraft (2) to remain afloat in water (38) when being boarded by passengers, its center of gravity (46) must remain substantially aligned (48) with its center of buoyancy (44), which is positioned vertically lower than the center of gravity (46). If substantial misalignment of the metacentric stability occurs due to an inordinate amount of weight, the watercraft (2) will simply tip over (50), toward the side from which it is being boarded, as illustrated in FIG. 7.

However, in the present invention, Applicant's have found through experimentation that by decreasing the distance (x) between the center of gravity (46) and the center of buoyancy (44), lateral stability is greatly enhanced. That is, as the distance (x) decreases, the amount of weight, applied to either one of the gunwales (40) or (42), required to tip-over the watercraft (2), increases. Designed in accordance with this principle, a watercraft will be less likely to tip over, even when the rated number of people for that watercraft attempt to simultaneously board the watercraft from the same gunwale.

Figure 8:
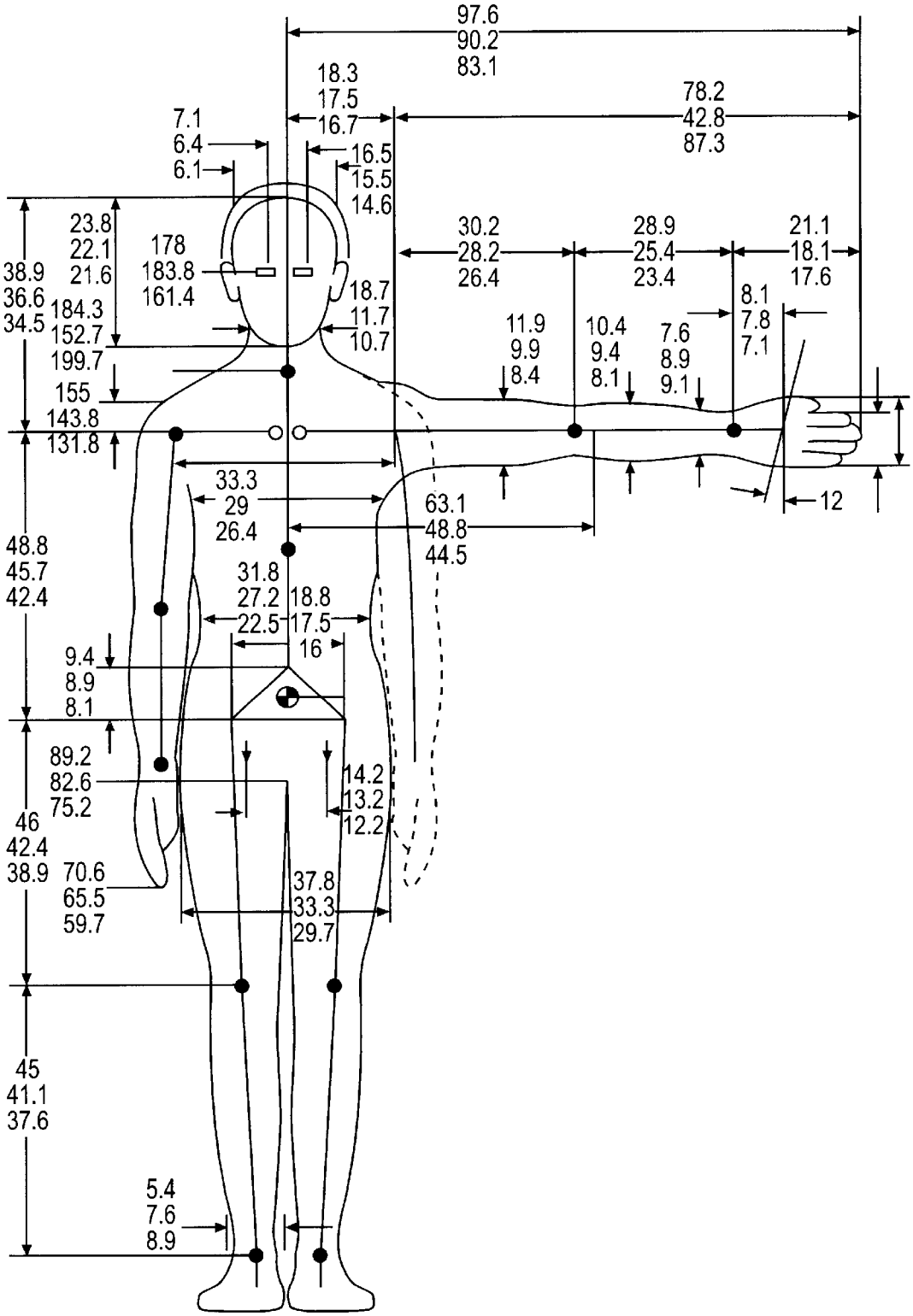
FIG. 8 is a drawing defining a standard person.

It should be noted that each watercraft is "rated" for (or approved for use with) a specific number of persons. The watercraft (2) of the present invention is rated for up to four passengers. With the lateral stability designed into this vehicle as described above, three or four adults of average size simultaneously may attempt to board the watercraft (2) from the same gunwale without the vehicle tipping over. An adult of average size is defined as an adult having a weight of at least 175 pounds. Appended herein as FIG. 8 is a drawing defining the dimensions of such a standard person. The stability features described herein conform to the standards for vessel stability, as defined in the American Society for Testing and Materials publication F1321-92, which is incorporated herein by reference.

The lateral stability of the watercraft (2) is also enhanced by the hour-glass shape thereof. As shown in FIG. 1, outwardly extending sections (102, 104, 106, 108) of the hull (4) and deck (3) provide additional areas that extend from a longitudinal line of the watercraft (2). These outwardly extending sections (102, 104, 106, 108) provide additional buoyant areas at positions outwardly further from the longitudinal centerline of the watercraft (2) than prior art watercraft of this type. The additional lateral buoyancy that these sections (102, 104, 106, 108) provide further enhances the lateral stability of the watercraft (2).

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A watercraft comprising:

a powered hull;

a deck attached to the hull defining a central area;

a straddle-type seat disposed on the central area of the deck; and a sun deck disposed on the deck, wherein the sun deck is disposed adjacent to a rear end of the straddle-type seat, wherein the sun deck extends transversely outward from the straddle-type seat, and wherein the sun deck is a platform defined by a substantially flat top surface disposed above the deck and a rear section that extends downwardly from the flat top surface, the sun deck being generally coextensive and contiguous with the straddle-type seat so that a person may lay across the sun deck.

2. The watercraft of claim 1, further comprising:

at least one storage compartment disposed at a stern of the watercraft beneath the sun deck and being accessible through an opening in the deck; and at least one section mounted to the deck and being moveable between a closed position where the compartment is covered and an open position where the compartment is accessible;

wherein, when in the closed position, a top surface of the at least one section defines at least a portion of the substantially flat top surface of the sun deck.

3. The watercraft of claim 2, wherein the at least one section includes a padded area forming at least a portion of the substantially flat top surface of the sun deck.

4. The watercraft of claim 2, wherein the at least one storage compartment comprises two storage compartments disposed side-by-side.

5. The watercraft of claim 4, wherein the at least one section comprises two sections disposed side-by-side, one for each of the compartments.

6. The watercraft of claim 5, wherein, when in the closed position, the top surfaces of the two sections define the substantially flat top surface of the sun deck.

7. The watercraft of claim 5, wherein the two sections are hingedly connected to the deck.

8. The watercraft of claim 2, further comprising:

a planar surface on the deck around the opening to the at least one storage compartment; and a seal attached to one of (i) an underside of the at least one section and (ii) the planar surface;

wherein the seal, when the at least one section is in the closed position, (i) engages the planar surface and the underside of the at least one section, and (ii) surrounds the opening to deter ingress of water into the at least one compartment.

9. The watercraft of claim 8, wherein the planar surface is lip-less.

10. The watercraft of claim 8, wherein the seal is elastomeric.

11. The watercraft of claim 1, wherein at least a portion of a top of the straddle-type seat and the substantially flat surface sun deck are disposed at a substantially same height above the deck.

12. The watercraft of claim 2, further comprising:

at least one grab handle positioned forwardly of the substantially flat top surface of the sun deck and at least one grab handle positioned rearwardly of the substantially flat surface of the sun deck, wherein the grab handles provide graduated access to the watercraft from the water.

13. The watercraft of claim 12, wherein:

the at least one forward grab handle comprises only one grab handle, and the at least one rearward grab handle comprises only one grab handle.

14. The watercraft of claim 12, further comprising:

a deck section extending downwardly from the sun deck to a rear deck, wherein the at least one rearward grab handle is disposed thereon.

15. A watercraft comprising:

a powered hull;

a deck attached to the hull defining a central area, the deck having a substantially vertical rear wall surface;

a straddle-type seat disposed on the central area of the deck;

a sun deck disposed on the deck, wherein the sun deck is disposed adjacent to a rear end of the straddle-type seat, and wherein the sun deck extends transversely to the straddle-type seat;

at least a first grab handle disposed on the central area of the deck between the straddle-type seat and the sun deck; and at least a second grab handle disposed on the substantially vertical rear wall surface of the deck between a top portion and a bottom portion thereof, wherein the first and second grab handles provide graduated access to the watercraft.

16. The watercraft of claim 15, further comprising:

a rear deck disposed rearwardly of the sun deck and spaced from the sun deck by the substantially vertical rear wall surface, and wherein at least the second grab handle is disposed between the sun deck and the rear deck.

17. The watercraft of claim 15, further comprising:

at least one storage compartment disposed at a stern of the watercraft beneath the sun deck and being accessible through an opening in the deck; and at least one section mounted to the deck and being moveable between a closed position where the compartment is covered and an open position where the compartment is accessible;

wherein, when in the closed position, a top surface of the at least one section defines at least a portion of the substantially flat top surface of the sun deck.

18. The watercraft of claim 17, wherein the at least one section includes a padded area forming at least a portion of the substantially flat surface of the sun deck.

19. The watercraft of claim 17, wherein the at least one storage compartment comprises two storage compartments disposed side-by-side.

20. The watercraft of claim 19, wherein the at least one section comprises two sections disposed side-by-side, one for each of the two storage compartments.

21. The watercraft of claim 17, further comprising:

a planar surface on the deck around the opening to the at least one storage compartment; and a seal attached to one of (i) an underside of the at least one section and (ii) the planar surface;

wherein the seal, when the at least one section is in the closed position, (i) engages the planar surface and the underside of the at least one section, and (ii) surrounds the opening to deter ingress of water into the at least one compartment.

22. The watercraft of claim 21, wherein the planar surface is lip-less.

23. The watercraft of claim 15, wherein at least a portion of a top of the straddle-type seat and the substantially flat surface sun deck are disposed at a substantially same height above the deck.

* * * * *